US012492096B2

(12) United States Patent
Miyamoto et al.

(10) Patent No.: US 12,492,096 B2
(45) Date of Patent: Dec. 9, 2025

(54) PAPER FOLDING DEVICE

(71) Applicant: DUPLO SEIKO CORPORATION, Kinokawa (JP)

(72) Inventors: Chikara Miyamoto, Kinokawa (JP); Masanobu Ohashi, Kinokawa (JP)

(73) Assignee: DUPLO SEIKO CORPORATION, Kinokawa (JP)

( * ) Notice: Subject to any disclaimer, the term of this patent is extended or adjusted under 35 U.S.C. 154(b) by 0 days.

(21) Appl. No.: 18/575,430

(22) PCT Filed: Jul. 6, 2021

(86) PCT No.: PCT/JP2021/025409
§ 371 (c)(1),
(2) Date: Dec. 29, 2023

(87) PCT Pub. No.: WO2023/281615
PCT Pub. Date: Jan. 12, 2023

(65) Prior Publication Data

US 2024/0308812 A1 Sep. 19, 2024

(51) Int. Cl.
*B65H 45/107* (2006.01)

(52) U.S. Cl.
CPC ..... *B65H 45/107* (2013.01)

(58) Field of Classification Search
CPC ..... B65H 45/107; B65H 45/04
(Continued)

(56) References Cited

U.S. PATENT DOCUMENTS 1,006,645 A * 10/1911 Froehlich ..... B31B 70/44 493/252
4,875,668 A * 10/1989 Spyra ..... B42C 3/00 270/32

(Continued)

FOREIGN PATENT DOCUMENTS

EP 4 067 275 A1 10/2022
JP S629947 A 1/1987

(Continued)

OTHER PUBLICATIONS

International Search Report (PCT/ISA/210) with translation and Written Opinion (PCT/ISA/237) mailed on Sep. 7, 2021, by the Japanese Patent Office as the International Searching Authority for International Application No. PCT/JP2021/025409. (11 pages).

(Continued)

*Primary Examiner* — Robert F Long
*Assistant Examiner* — Xavier A Madison
(74) *Attorney, Agent, or Firm* — BUCHANAN INGERSOLL & ROONEY PC

(57) ABSTRACT

An object of the present disclosure is to prevent wrinkles in a folding line portion of a paper irrespective of the conditions such as the type, the size, and the like of the paper, thereby securing the precision of the position of a folding line when a flap (such as a flap portion) of an envelope is folded back. The folding unit comprises a pair of an upper and a lower guide plates that defines part of the paper conveyance path at the folding position, and the folding plate is configured so that, when turning from the placement position to the overlap position, a lower face of the folding plate overlaps an upper face of the upper guide plate of the pair of the upper and the lower guide plates.

7 Claims, 13 Drawing Sheets

(58) Field of Classification Search
USPC ..... 493/405
See application file for complete search history.

(56) References Cited

U.S. PATENT DOCUMENTS

| | | | | |
|---|---|---|---|---|
| 5,259,827 | A * | 11/1993 | Staniszewski | B65H 45/04 493/23 |
| 2001/0044368 | A1 | 11/2001 | Blumle | |
| 2006/0281620 | A1 | 12/2006 | Hayashi et al. | |
| 2008/0171644 | A1 | 7/2008 | Cailloux et al. | |
| 2014/0206516 | A1 | 7/2014 | Hata et al. | |

FOREIGN PATENT DOCUMENTS

| | | | |
|---|---|---|---|
| JP | S63104376 | U | 7/1988 |
| JP | H07285733 | A | 10/1995 |
| JP | H09240628 | A | 9/1997 |
| JP | 11029257 | A | 2/1999 |
| JP | 2002307574 | A | 10/2002 |
| JP | 2006341991 | A | 12/2006 |
| JP | 2008173973 | A | 7/2008 |
| JP | 2014144848 | A | 8/2014 |
| JP | 2016005992 | A | 1/2016 |
| JP | 2019131333 | A | 8/2019 |
| WO | 2021106835 | A1 | 6/2021 |

OTHER PUBLICATIONS

Extended European Search report issued in corresponding European Patent Application No. 21949251.9, dated Jul. 22, 2025 (7 pages).
Office Action (Notice of Reasons for Refusal) issued on Apr. 23, 2024, by the Japanese Patent Office in corresponding Japanese Patent Application No. 2020-072047, and an English Translation of the Office Action. (6 pages).
Office Action (Notice of Reasons for Refusal) issued on Nov. 30, 2023, by the Japanese Patent Office in corresponding Japanese Patent Application No. 2020-072047, and an English Translation of the Office Action. (10 pages).

* cited by examiner

PAPER FOLDING DEVICE

TECHNICAL FIELD

The present invention relates to a paper folding device. Particularly, the present invention relates to a paper folding device advantageous for a paper bag making machine, a sealing device, and the like that manufacture envelopes.

BACKGROUND ART

A sealing device including a paper folding mechanism that folds back a flap while moving an envelope along a predetermined conveyance path (for example, Patent Document 1) is configured such that the envelope having an adhesive film adhering thereto is conveyed to a flap pressing mechanism (a paper folding mechanism) and, at this position, a folding plate turns to fold the flap and press the flap to a main body of the envelope so that the flap is thereby pasted to the main body of the envelope.

PATENT DOCUMENT

Patent Document 1: JP H9-240628 A

SUMMARY OF THE INVENTION

With the paper folding mechanism of the above sealing device, however, an adverse influence may act on the quality of the deliverables due to the fact such as that the conveyance state of a paper is not stabilized to form wrinkles in a folding line portion of the paper depending on the conditions such as the type and the size of the paper to be folded. It can also be considered that problems arise such as that, when the folding plate turns to fold a flap portion, the paper is displaced in a processing part to degrade the precision of the position of a folding line.

In view of the above problems with the paper folding mechanism that folds back the flap portion of the envelope as the above traditional technique, an object of the present invention is to provide a paper folding mechanism (a paper folding device) that prevents occurrence of wrinkles in a folding line portion of a paper irrespective of the conditions such as the type, the size, and the like of the paper, that secures the precision of the position of a folding line when a flap (such as a flap portion) of an envelope is folded back, and that therefore does not cause adverse influence on the quality of the deliverables during the processing.

DETAILED DESCRIPTION

Figure 1:
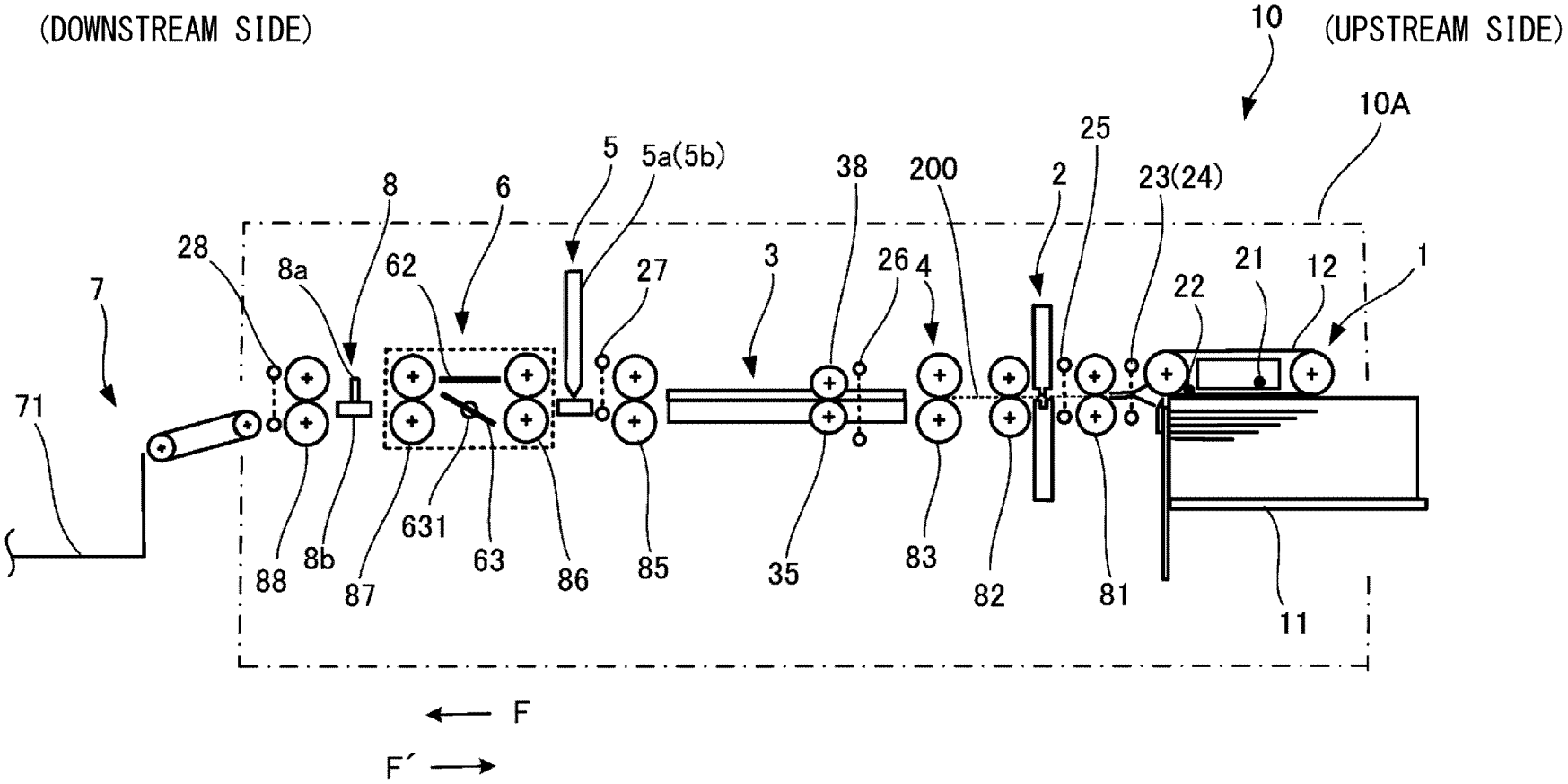
FIG. 1 is a schematic overall configuration diagram of a paper bag making machine of the first embodiment of the present invention.

FIG. 1 shows a paper bag making machine 10 of an embodiment that employs a paper folding device (first folding section 3) of the present invention. FIG. 1 is an overall configuration diagram of the paper bag making machine 10. The paper bag making machine 10 includes, in a device main body 10A, sequentially from the upstream side in a conveyance direction, a paper feeding section 1, a first creasing section 2, a second creasing section 4, the first folding section 3, a paste applying section 5, a second folding section 6, and a paper discharging section 7.

Figure 4:
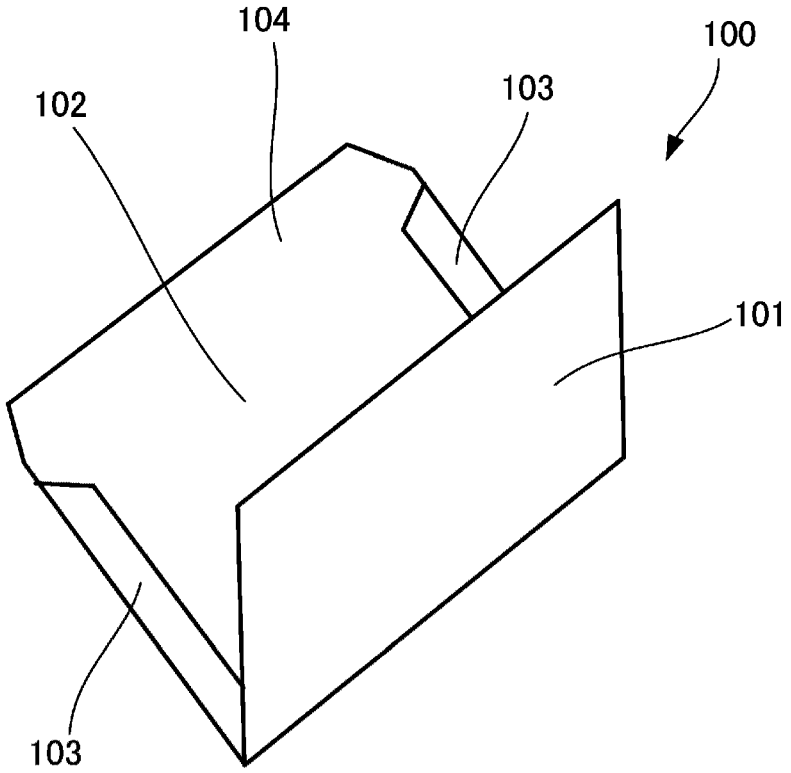
FIG. 4 is a perspective view showing the state of a Western-style envelope that is in the course of its manufacture.
Figure 5A:
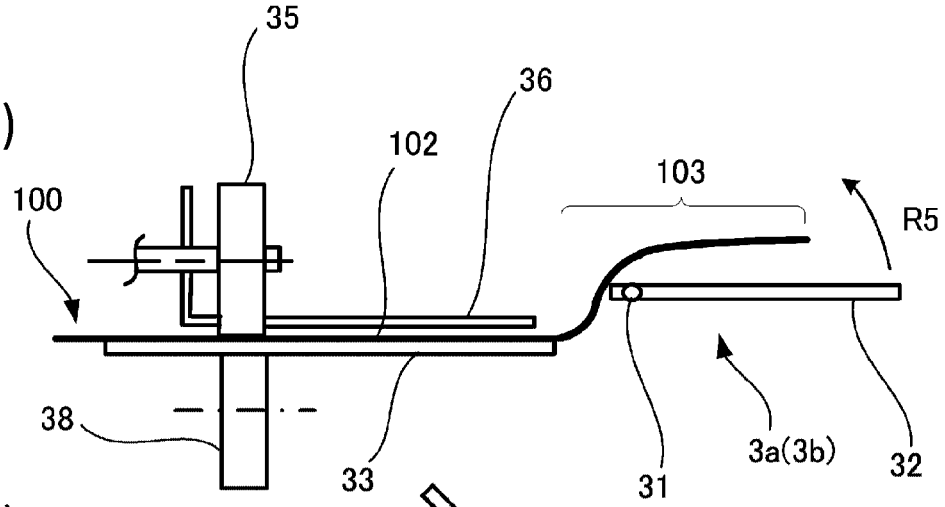
FIGS. 5(*a*) to 5(*d*) are diagrams showing the states before and after a folding plate in a first folding section is folded.
Figure 5B:
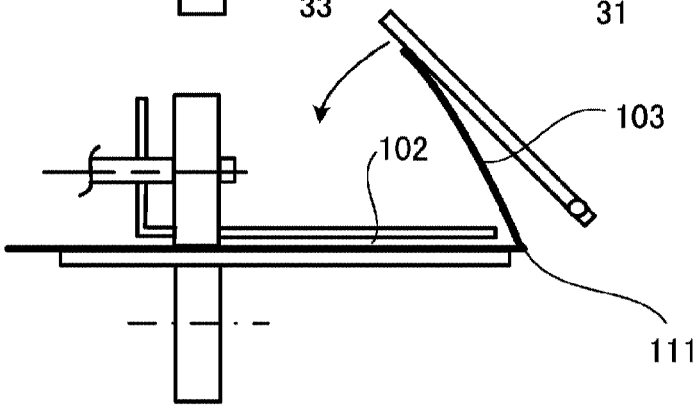
Figure 5C:
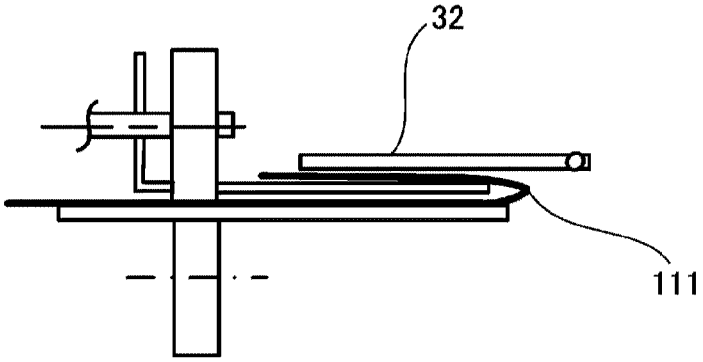
Figure 5D:
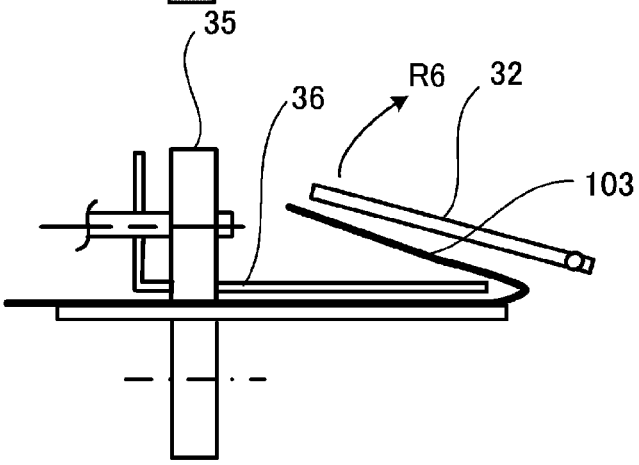

A "Western-style envelope" having a general form has a laterally elongated rectangular shape and has an opening to be sealed formed along a longer side thereof. When a Western-style envelope is manufactured by the paper bag making machine 10, for example, as shown in FIG. 4, a paste is applied to a strip portion 103 that is folded back on each of both sides of a back plane portion 102 of a paper 100 and a front plane portion 101 is folded back to be press-bonded to the strip portion 103.

Figure 2A:
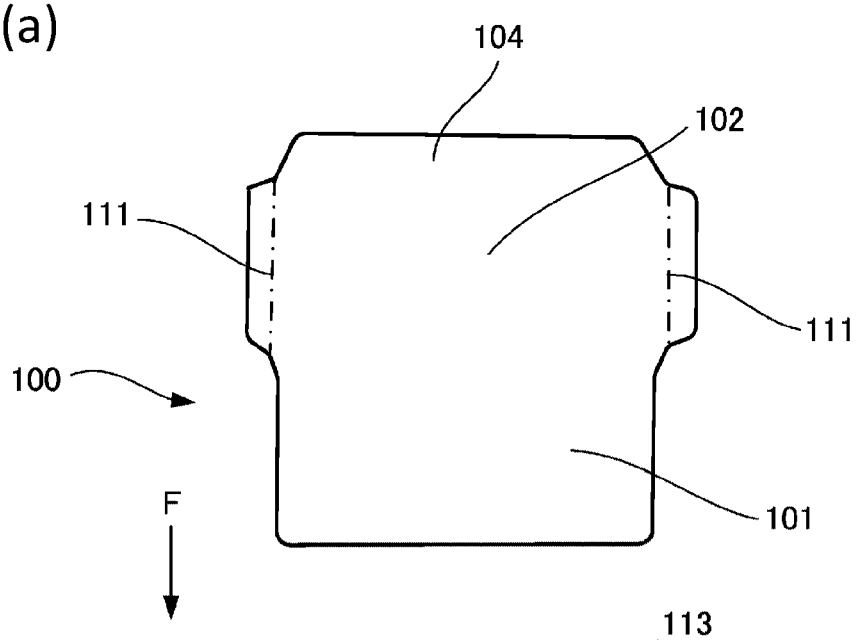
FIGS. 2(*a*) to (*c*) are plan views showing the state of a paper processed by the paper bag making machine in FIG. 1.
Figure 2B:
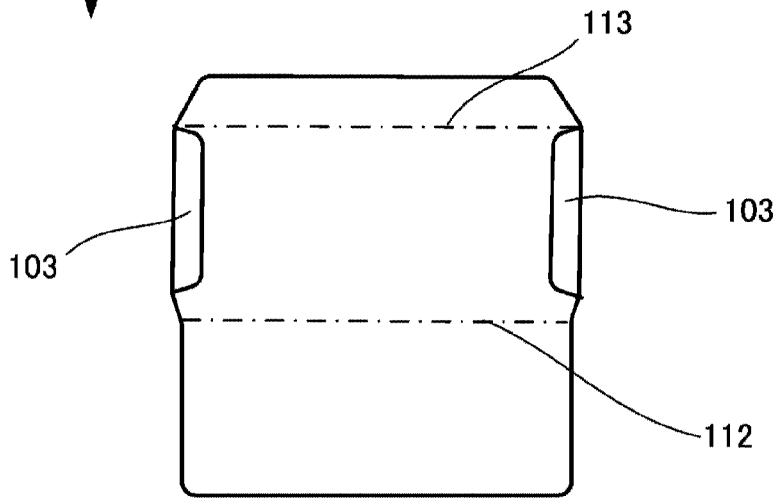
Figure 2C:
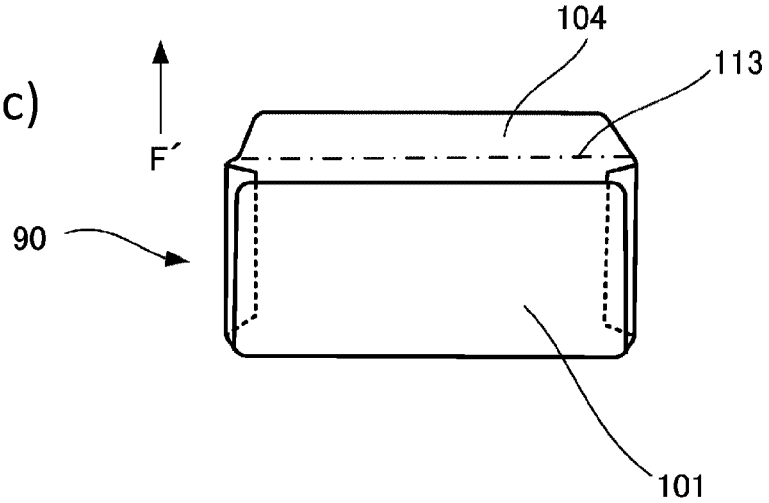

For example, the paper bag making machine 10 is configured to manufacture a Western-style envelope 90 by processing, as shown in FIG. 2(*b*) and FIG. 2(*c*), the flat paper 100 shown in FIG. 2(*a*), conveying the paper 100 in an F-direction.

The paper 100 includes the front plane portion 101, the back plane portion 102, a strip portion for a paste margin strip portion (a flap) 103 that projects on each of both sides of the back plane portion (a body part) 102, and a backmost plane portion 104. As shown in FIG. 2(*b*), the paper 100 is configured to be folded along each of first folding lines 111 that each are the border line between the back plane portion 102 and the strip portion 103 and, as shown in FIG. 2(*c*), to further be folded along a second folding line 112 that is the border line between the front plane portion 101 and the back plane portion 102. A paste is applied onto the surface of each of the strip portions 103 each folded back along the first folding line 111. Both of the edge portions of the front plane portion 101 that is folded back along the second folding line 112 are each spliced to the strip portion 103. The first folding lines 111 are present along the conveyance direction. The second folding line 112 is present along the direction perpendicular to the conveyance direction (that is, the width direction).

Figure 3A:
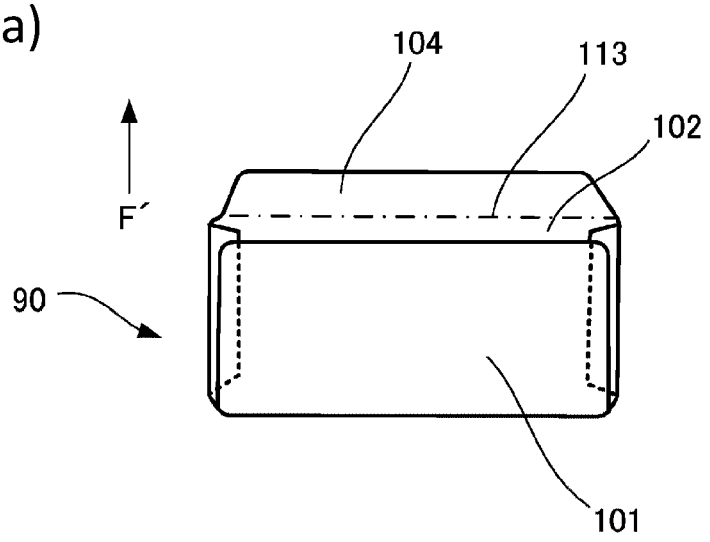
FIGS. 3(*a*) and 3(*b*) are plan views showing the state of the paper in FIGS. 2(*a*) to 2(*c*) that undergoes folding.
Figure 3B:
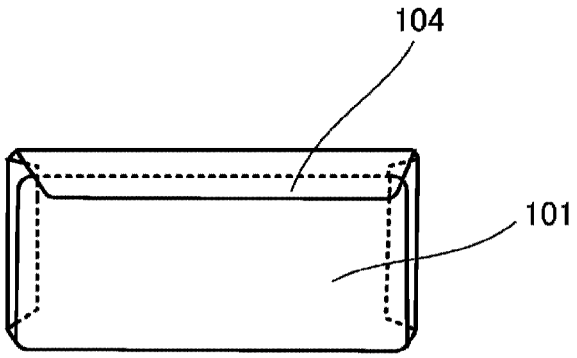

A deliverable may be the Western-style envelope 90 in FIG. 2(*c*), or the paper bag making machine 10 may be configured such that the Western-style envelope 90 shown in FIG. 2(*c*) is processed as shown in FIG. 3 conveying the Western-style envelope 90 in an F'-direction to thereby further fold the backmost plane portion 104 along a third folding line 113 that is the border line between the back plane portion 102 and the backmost plane portion 104. According to the above configuration, when the envelope is sealed using a tape or a paste after inserting a content into the envelope, the third folding line 113 has a tendency to be folded and the backmost plane portion 104 can therefore be neatly sealed onto the front plane portion 101 that is folded back.

[Paper Feeding Section 1]

A paper feeding section 1 includes an air paper feeding unit 12 of an air suction belt type, a paper feeding tray 11 of an elevator type, that ascends or descends depending on the loaded amount of papers, and conveying rollers 81 that convey each of the papers fed out by the air paper feeding unit 12 further to the downstream side in the conveyance direction. In the air paper feeding unit 12, such sensors are disposed as a sensor 22 that detects the fact that a paper in the topmost face of the papers loaded on the paper feeding tray 11 is suctioned onto the lower face of the air paper feeding unit 12, and a sensor 21 that detects the upper limit position of the topmost face of the papers loaded on the paper feeding tray 11.

The paper bag making machine 10 includes five conveying roller pairs 82, 85, 86, 87, and 88 in addition to the conveying rollers 81. The five conveying roller pairs define a conveyance face 200 on which the paper 100 is conveyed, and the conveyance face 200 is the same one flat face from the air paper feeding unit 12 to the conveying roller pair 88. On the conveyance face 200 on which the paper is conveyed, such sensors are disposed as a sensor 23, a sensor 24, a sensor 25, a sensor 26, a sensor 27, and a sensor 28 that each detect the passage of the paper at each of their positions (that detect conveyance of overlapping papers). For example, an optical transmission sensor is used as each of the sensors.

[First Creasing Section 2]

As shown in FIG. 1, a first creasing section 2 includes, in its upper portion, an upper mold having a convex shape and, in its lower portion, a lower mold having a concave shape, and is configured to form transverse creases in the direction perpendicular to the paper conveyance direction as the second folding line 112 and the third folding line 113 of the paper 100. A known mechanism can be employed as the creasing part 2.

[Second Creasing Section 4]

As shown in FIG. 1, a second creasing section 4 includes a crease blade 83 including an upper blade that has a round blade shape and whose outer circumferential portion has convex portions formed thereon, and a lower blade that has a round blade shape and whose outer circumferential portion has concave portions formed thereon, is disposed at each of two points in the width direction that is the direction perpendicular to the conveyance direction, and is configured to form a longitudinal crease along the paper conveyance direction on the first folding line 111 (at tach of their two points) of the paper 100. A known mechanism can be employed as the second creasing section 4. The crease blade 83 may include an upper blade that has a round blade shape and whose outer circumferential portion has concave portions formed thereon and a lower blade that has a round blade shape and whose outer circumferential portion has convex portions formed thereon,

[First Folding Section 3]

Figure 6:
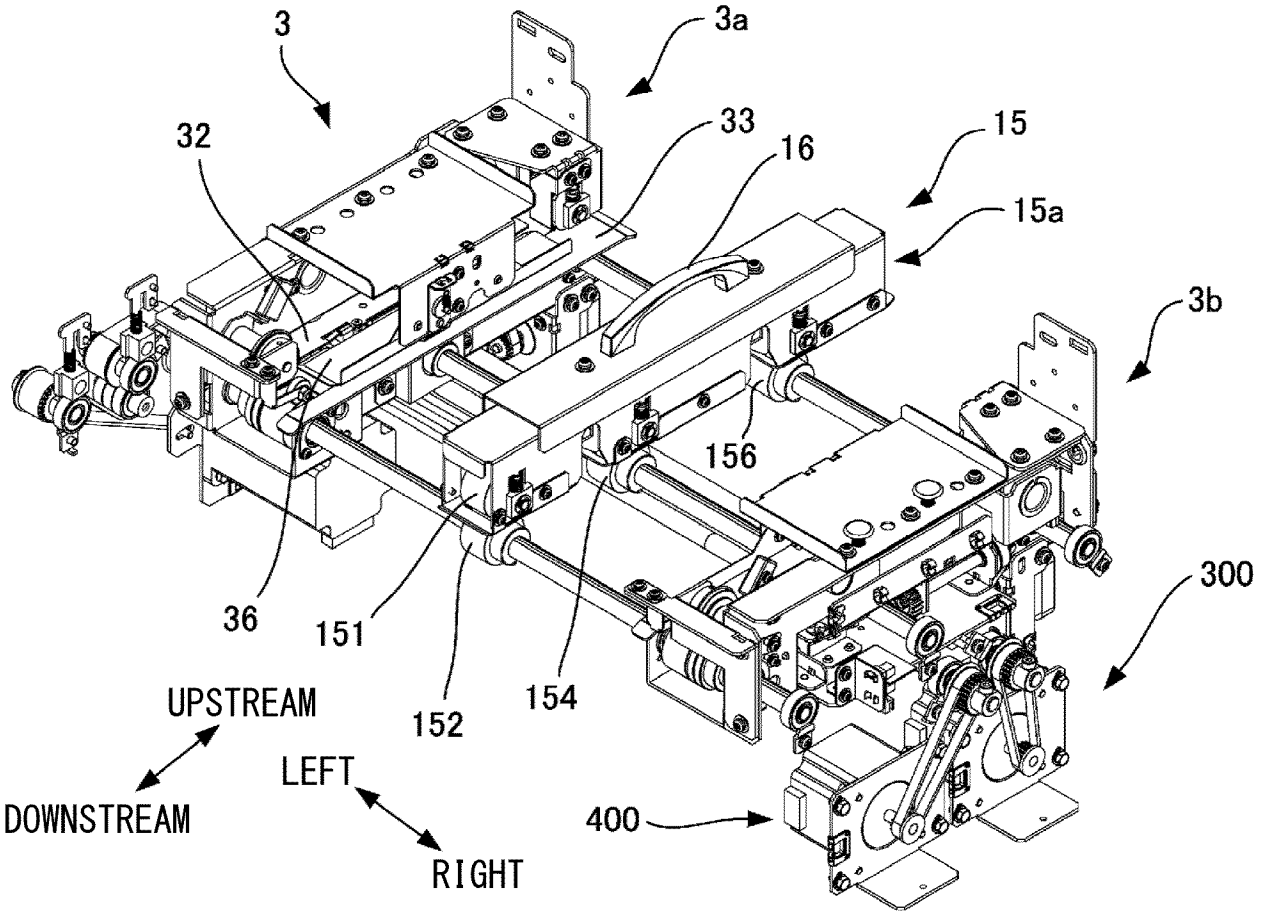
FIG. 6 is a perspective view showing the overall configuration of the first folding section.
Figure 7:
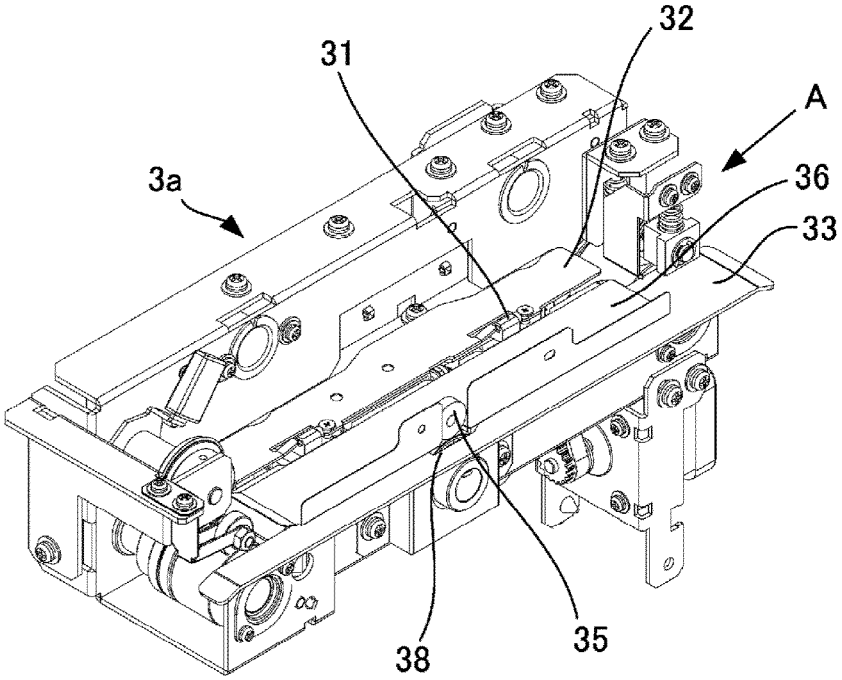
FIG. 7 is a perspective view showing the configuration of the first folding unit.

FIG. 6 is a perspective view showing the overall configuration of the first folding section; 3. The first folding section 3 includes a pair of folding units (the first folding unit 3*a* and the second folding unit 3*b*) disposed facing each other on both sides in the width direction that is the direction perpendicular to the paper conveyance direction as shown in FIG. 6 as a folding unit for the flaps 103 on the right and the left of the paper 100. The pair of folding units 3*a* and 3*b* have a bilaterally symmetric configuration. FIG. 7 shows the first folding unit 3*a* disposed on the left side in FIG. 6, and the first folding unit 3*a* includes a folding plate 32 that turns around a turning shaft 31 along the conveyance direction. The first folding unit 3*a* includes an upper guide plate 36 that is disposed putting a predetermined gap above a lower guide plate 33, and also includes a pair of conveying roller pair (a driving roller 38 and a driven roller 35) that convey the paper 100 conveyed on the lower guide plate 33, to the downstream side. In FIG. 7, a rotating shaft of the driven roller 35 and other driving mechanisms are not shown.

The paper bag making machine 10 includes the pair of folding units of the first folding unit 3*a* and the second folding unit 3*b* that are disposed facing each other on both sides in the width direction that is the direction perpendicular to the paper conveyance direction, each as a folding unit, and the folding back process can therefore be executed for the flap 103 concurrently at two points in one paper conveyance session in the case of a paper having flaps at two points on both sides in the width direction that is the direction perpendicular to the paper conveyance direction, and the workability is excellent.

In FIG. 6, a conveying unit 15 that conveys the paper holding the central portion of the paper on the conveyance path is further disposed between the first folding unit 3*a* and the second folding unit 3*b*. The conveying unit 15 includes pairs of upper and lower conveying rollers 151, 152, 153, 154, 155, and 156 and, of the pairs of the upper and the lower conveying rollers, the upper side conveying rollers 151, 153 (not shown), and 155 (not shown) are unitized and this unit is configured such that an operator holds a handle of a unit 15*a* and can easily attach or detach the unit 15*a* from the paper folding device main body 10 for a paper jam or maintenance.

The conveying unit 15 that conveys the paper holding the central portion of the paper on the conveyance path is further disposed between the first folding unit 3*a* and the second folding unit 3*b*. The conveyance of the paper is therefore stabilized and the processing precision is also stabilized especially in the case where the folding back process for the flap is executed concurrently at two points in one paper conveyance session.

As shown in FIG. 5(*a*), the first folding unit 3*a* each includes the folding plate 32 that turns around the turning shaft 31 along the conveyance direction, further includes the upper guide plate 36 that is disposed putting a predetermined gap above a lower guide plate 33, and also includes the pair of conveying roller pair (the driving roller 38 and the driven roller 35) that convey the paper 100 conveyed on the lower guide plate 33, to the downstream side. The lower guide plate 33 has a cutout formed in a nip portion of the roller pair.

At a folding position where the flap 103 of the paper is folded, the strip portion 103 of the paper 100 placed on the folding plate 32 in the state of being positioned on the outer side in the width direction as in FIG. 5(*a*) can be folded back into the inner side to overlap on the surface of the back plane portion (the body part) 102 through the upper guide plate 36 as in FIG. 5(*c*) by causing the folding plate 32 to turn in an R5-direction as in FIG. 5(*b*).

According to the above, the flap of the paper is folded back onto the upper face of the upper guide plate keeping the body part of the paper held between the pair of the upper and the lower guide plates (36 and 33), and occurrence of any wrinkle can therefore be prevented in the folding line portion of the paper during the processing and the precision of the position of the folding line can further be secured when the flap is folded.

A turning mechanism 300 of the folding plate 32 will next be described with reference to FIG. 8 and FIG. 9.

Figure 8:
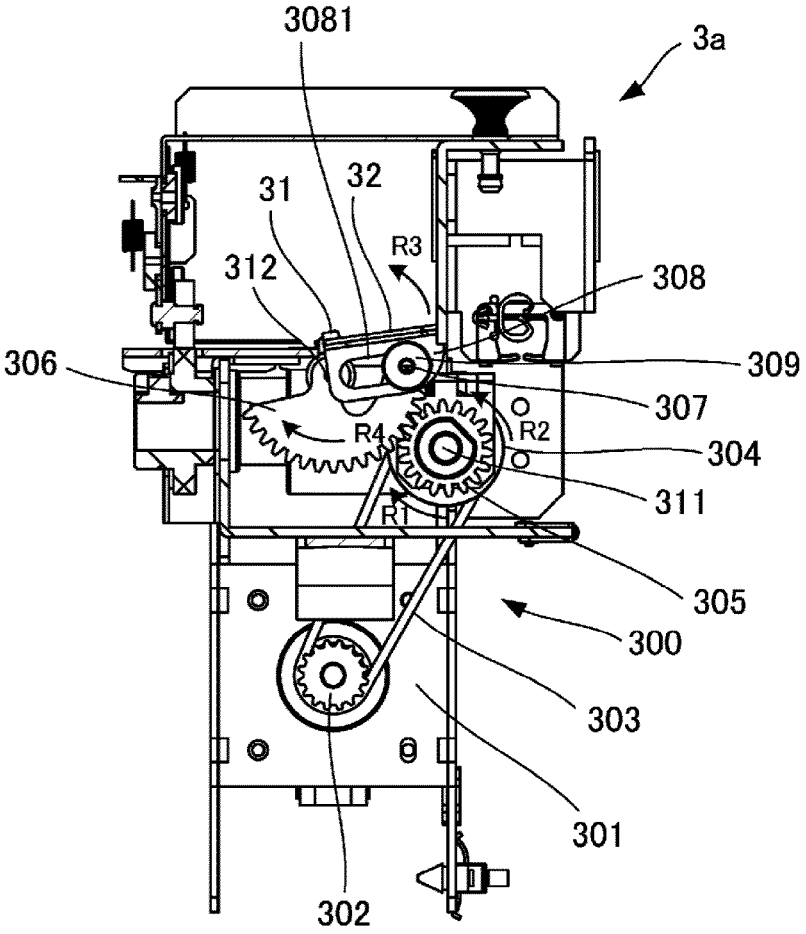
FIG. 8 is a diagram showing a rotation mechanism of a folding plate of the first folding unit.
Figure 9:
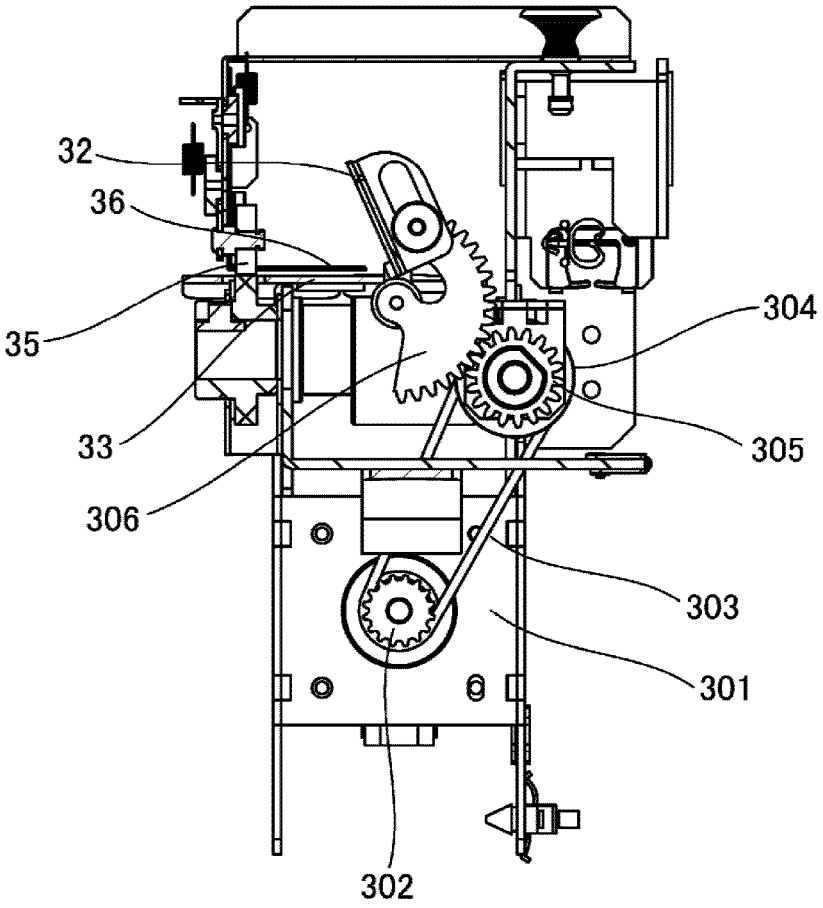
FIG. 9 is a diagram showing the rotation mechanism of the folding plate of the first folding unit.

FIG. 8 shows the state where the folding plate 32 is set to be at a placement position where the flap 103 of the paper is placed, and FIG. 9 shows the state where the folding plate 32 is in the course of arriving at an overlap position where the flap 103 of the paper is overlapped toward the body part. FIG. 8 and FIG. 9 are each a front elevation view of the first folding unit 3*a* in FIG. 7 seen from an A-direction. The second folding unit 3*b* has the same configuration as that of the first folding unit 3*a* and therefore will not again be described.

As shown in FIG. 8, the first folding unit 3*a* includes the folding unit including the folding plate 32 that reciprocally turns around the shaft 31 along the conveyance direction. The folding plate 32 is disposed to turn by 180 degrees on a horizontal plane. The turning mechanism 300 of the folding plate 32 includes a motor 301, a first pulley 302, a transmission belt 303, a second pulley 304, a rotating gear 305, a swinging gear 306, a sliding shaft 307, and a sliding receiving part 308. The transmission belt 303 is wound on the first pulley 302 and the second pulley 304. The second pulley 304 and the rotating gear 305 are integrally supported by a turning shaft 311. The swinging gear 306 is supported by a turning shaft 312. The sliding shaft 307 protrudes from an upper end portion of the swinging gear 306. The sliding receiving part 308 is integrally formed with the folding plate 32 in a direction perpendicular to the folding plate 32. The sliding receiving part 308 has a sliding groove 3081 formed thereon that receives the sliding shaft 307. The sliding shaft 307 is freely movably engaged with the sliding groove 3081 through a spacer 309.

The turning mechanism 300 is configured to act as below. When the motor 301 acts, the rotating gear 305 rotates through the first pulley 302, the transmission belt 303, and the second pulley 304. When the rotating gear 305 rotates, the swinging gear 306 swings and the folding plate 32 turns.

When the rotating gear 305 rotates in an R1-direction, the swinging gear 306 swings in an R3-direction, the sliding shaft 307 moves in the sliding groove 3081 of the sliding receiving part 308, and, as a result, the folding plate 32 turns in the R5-direction. On the contrary, when the rotating gear 305 rotates in an R2-direction, the swinging gear 306 swings in an R4-direction, the sliding shaft 307 moves in the sliding receiving part 308, and, as a result, the folding plate 32 turns in an R6-direction. According to the turning mechanism 300, the folding plate 32 can therefore be caused to turn by 180 degrees on the horizontal plane as shown in FIGS. 5(*a*) to (*c*). According to the first folding unit 3*a*, as shown in FIG. 5(*a*), the strip portion 103 of the paper 100 placed on the folding plate 32 in the state of being positioned on the outer side in the width direction, can thereby be folded back into the inner side to overlap the back plane portion 102 on the surface thereof through the upper guide plate 36, by causing the folding plate 32 to turn in the R5-direction.

The position of the folding plate 32 (the angle of its inclination) in FIG. 9 corresponds to that in FIG. 5(*b*) that shows the state of the folding plate 32 in the course of its moving from the placement position shown in FIG. 5(*a*) to the overlap position.

[Paste Applying Section 5]

The paste applying section 5 includes a pair of applying devices 5*a* and 5*b* that are disposed facing each other on both sides in the width direction. The applying device 5*a* and the applying device 5*b* have a bilaterally symmetric configuration.

The applying devices 5*a* and 5*b* each include a nozzle part, a position setting mechanism, and an up and down driving mechanism (all not shown). The nozzle part is configured to apply a paste to the conveyed paper at a predetermined timing.

[Second Folding Section 6]

The second folding section 6 is a paper folding device that folds, the flat paper 100 conveying the paper 100 along the conveyance face 200, and includes a first conveying roller pair 86 disposed on its upstream side in the paper conveyance direction, a second conveying roller pair 87 disposed on its downstream side in the paper conveyance direction, a switching gate plate 63 disposed between the roller pairs, and a folding plate 62 disposed above the switching gate plate 63.

The switching gate plate 63 can turn centering a supporting shaft 631 and the position thereof is switchable between a first leading position to interfere with the conveyed paper 100 to lead upward a front tip portion of the paper 100 for the front tip portion to pass on the upper surface of an upper roller 871 of the second conveying roller pair 87 and a second leading position to lead the front tip portion in a substantially horizontal direction toward a nip portion 873 of the second conveying roller pair 87, and the folding plate 62 is configured to be movable in the up-down direction keeping its substantially horizontal state and the position of the folding plate 62 is switchable between a folding position to be approximated to the switching gate plate 63 that is disposed at the second leading position and a retreat position to be retreated putting a predetermined space from the switching gate plate.

[Pressurizing Part 8]

A pressurizing part 8 includes an upper mold 8*a* that is movable in the up-down direction and a lower mold 8*b* that is immovable, and strengthens the folding portion of the paper 100 that is folded by the second folding section 6, by clamping the folding portion between the upper mold and the lower mold to thereby further pressurize the folding portion.

[Paper Discharging Section 7]

The paper discharging section 7 includes the conveying roller pair 88 and a paper discharge tray 71. The conveying roller pair 88 is disposed to act as discharging rollers. For example, as shown in FIG. 1, the conveying roller pair 88 is disposed in the vicinity of the second conveying roller pair 87 of the second folding section 6 and downstream in the conveyance direction. The paper discharge tray 71 inclines obliquely upward from a position lower than the conveyance face 200 and toward the downstream in the conveyance direction.

An action of the paper bag making machine 10 having the above configuration will next be described.

The paper 100 shown in FIG. 2 is first placed on the paper feeding tray 11. At this time, the front plane portion 101 is positioned on the downstream side in the conveyance direction. A switch (not shown) is turned on to start the action.

(1) The paper 100 in the topmost face on the paper feeding tray 11 is fed out toward the conveying roller pair 81 being suctioned by an air suction belt in the air paper feeding unit 12 and, after the paper 100 is delivered to the conveying roller pair 81, the paper 100 is further conveyed to the downstream side in the conveyance direction by the conveying roller pair 81. The paper 100 thereafter passes through the first creasing section 2. At this time, the first creasing section 2 acts and a crease is thereby formed on each of the second folding line 112 and the third folding line 113 of the paper 100. The front plane portion 101 is thereby easily folded back to the side of the back plane portion 102. The backmost plane portion 104 is thereby also easily folded back to the side of the front plane portion 101 that is already folded back.

(2) The paper 100 conveyed from the first creasing section 2 passes through the second creasing section 4. At this time, the first folding lines 111 (at the two points on the right and the left in the width direction) of the paper 100 are each positioned immediately under the crease blade (the round blade) of the second creasing section 4 disposed each of the two points in the width direction that is the direction perpendicular to the conveyance direction. The second creasing section 4 acts and the crease is thereby formed on each of the first folding lines 111. The strip portions 103 (at the two points on the right and the left in the width direction) are each thereby easily folded back into the inner side.

(3) The paper 100 having the creases thereon that are formed by the second creasing section 4 stops at the first folding section 3. The precision of the positions for the folding line process used when the flaps are folded can be secured by forming the creases in advance on the folding lines (111) used when the flaps 103 of the paper are folded.

As shown in FIG. 5, the first folding section 3 includes the upper guide plate 36 that is disposed putting the predetermined gap above the lower guide plate 33 and the conveying roller pair (the driving roller 38 and the driven roller 35) that conveys the paper 100 conveyed on the lower guide plate 33 further to the downstream side, in addition to the basic configuration for the folding back of each of the strip portions 103 by the folding plate 32. The lower guide plate 33 has the cutout formed in the nip portion of the conveying roller pair.

In FIG. 5(*a*), the folding plate 32 of the folding unit 3*a* (3*b*) of the first folding section 3 is positioned on the outer side in the width direction and the strip portions 103 on both sides of the paper 100 are each placed on the folding plate 32 (the placement position).

In FIG. 5(*b*), the folding plate 32 next turns in the R5-direction toward the lower guide plate 33 on the inner side, and the strip portions 103 are thereby each folded back into the inner side along the first folding limes 111 that are each already processed for the crease and each overlap the back plane portion (the body part) 102 through the upper guide plate 36 as shown in FIG. 5(*c*) (the overlap position).

In FIG. 5(*d*), the folding plate 32 thereafter turns in a direction R6 to become distant from the lower guide plate 33 on the outer side. The paper 100 whose strip portions 103 are folded back is conveyed downstream in the conveyance direction by the conveying roller pair (the driving roller 38 and the driven roller 35). The paper after the folding can be smoothly conveyed toward the downstream side in the paper conveyance direction of the folding position without being interfered by the folding plate and the pair of the upper and the lower guide plates by causing the folding plate 32 to turn in the direction R6 to become distant from the lower guide plate 33 by at least a predetermined angle before the conveyance of the paper 100 is started.

In FIG. 5(*a*) to FIG. 5(*d*) descried above, the folding unit 3*a* includes the upper guide plate 36 and the driven roller 35 as a pressing roller that holds the paper 100 on the upper guide plate 36 and, when the folding unit folds the flap 103 of the paper, a controller controls such that the driving of the pair of conveying rollers (the driving roller 38 and the driven roller 35) is set in a stoppage state at the folding position to stop the conveyance of the paper 100 and the flaps 103 of the paper 100 are folded keeping the body part 102 of the paper 100 held between the pair of conveying rollers 38 and 35.

According to the above, the flaps 103 of the paper are folded back onto the upper face of the upper guide plate 36 keeping the body part 102 of the paper held between the pair of the upper and the lower guide plates 36 and 33 and, concurrently and, at the same time, the flaps 103 of the paper are folded keeping the body part 102 of the paper held between the pair of conveying rollers 36 and 33. The precision of the positions of the folding lines used when the flaps 103 are folded back can therefore be further secured.

(4) The paper 100 whose strip portions 103 are folded back is conveyed downstream in the conveyance direction by the conveying roller pair 85, and passes through the paste applying section 5. At the paste applying section 5, when the passage of the folded back strip portions 103 on both sides of the paper 100 starts, the nozzle parts 5*a* and 5*b* disposed at two points in the width direction that is the direction perpendicular to the conveyance direction move downward to abut onto the surfaces of the strip portions 103 and, when the passage of the strip portions 103 comes to an end, the nozzle parts 5*a* and 5*b* move upward and the nozzle parts 5*a* and 5*b* move to become distant from the surfaces of the strip portions 103. A paste is thereby applied onto each of the surfaces of the folded back strip portions 103. The folded back strip portions 103 pass under the nozzle parts 5*a* and 5*b* in the state where the strip portion 103 are pressed, or after being pressed by the conveying roller pair 85 positioned upstream in the conveyance direction of the nozzle parts 5*a* and 5*b*. The paste application work by the nozzle parts 5*a* and 5*b* can therefore be stably executed.

(5) The second folding section 6 is a paper folding device that folds the flat paper 100 conveying the flat paper 100 along the conveyance face 200, and includes the first conveying roller pair 86 disposed on the upstream side in the paper conveyance direction, the second conveying roller pair 87 disposed on the downstream side in the paper conveyance direction, a switching gate plate 63 disposed on the paper conveyance face 200 between the roller pairs, a folding plate 62 disposed facing the switching gate plate 63, and a controller (not shown) that controls the action of the overall device.

The position of the switching gate plate 63 is switchable between a first leading position where the switching gate plate 63 interferes with the conveyed paper 100 to outwardly divert the conveyance direction for the paper from the paper conveyance face 200 and leads the front tip portion of the paper 100 toward the surface of one roller of the second conveying roller pair 87, and a second leading position the switching gate plate 63 leads the front tip portion toward a nip portion 873 of the second conveying roller pair 87 along the paper conveyance face 200. The folding plate 62 is configured to be movable toward the switching gate plate 63 keeping its substantially horizontal state and the position of the folding plate 62 is switchable between a folding position where the folding plate 62 approximates to the switching gate plate 63 positioned at the second leading position and a retreat position where the folding plate 62 retreats putting a predetermined gap from the switching gate plate 63. The controller is configured to control such that the front tip portion of the conveyed paper 100 is led to pass by a predetermined amount toward the surface of the one roller of the second conveying roller pair 87, by the switching gate plate 63 positioned at the first leading position the switching gate plate 63 is thereafter switched to be at the second leading position, and the folding plate 62 positioned at the retreat position is thereafter lowered to the folding position keeping its substantially horizontal state to clamp the paper 100 on the switching gate plate 63 to thereby fold back the front tip portion of the paper 100 along the surface of the one roller of the second conveying roller pair 87.

For example, as one Example, processing is sequentially executed as described below.

Figure 10:
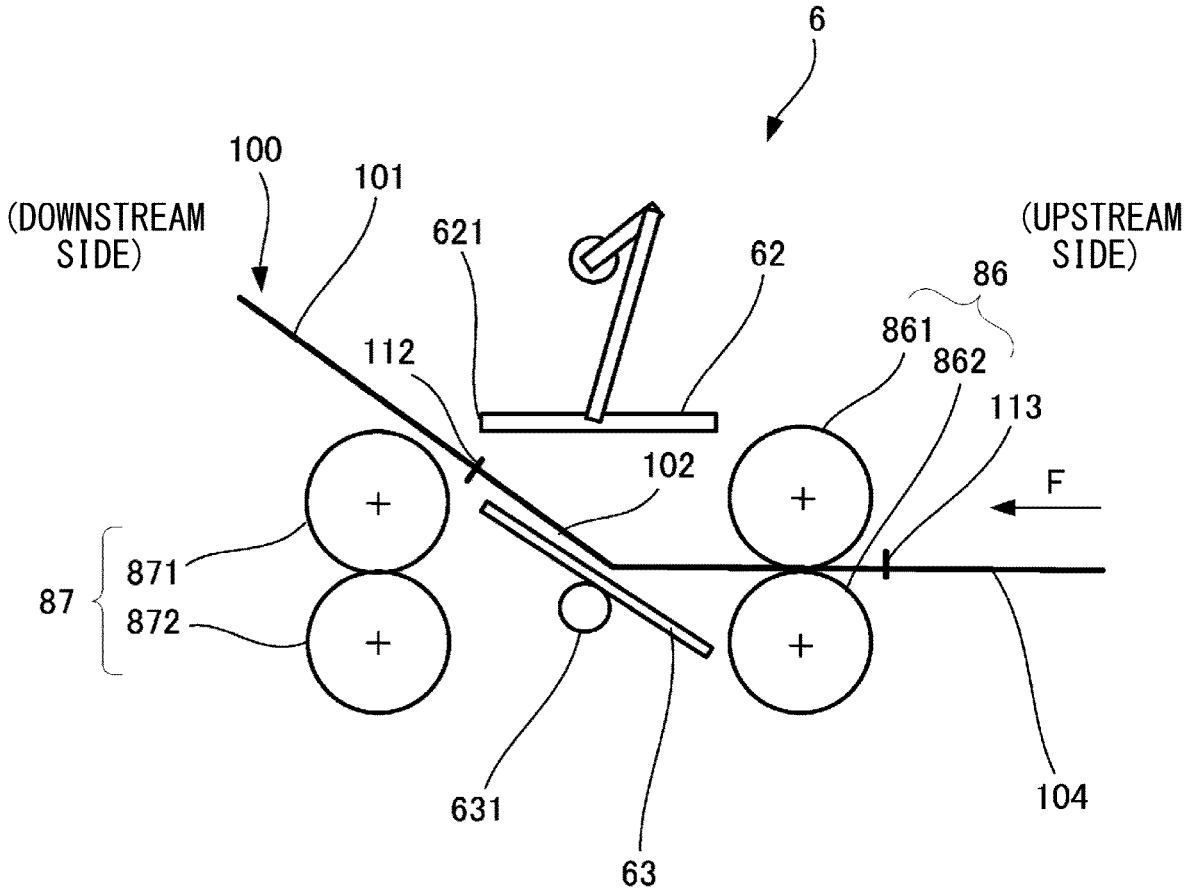
FIG. 10 is a diagram showing the state of processing for a paper in the second folding section.

The paper 100 whose strip portions 103 each have a paste applied thereon is conveyed to the second folding section 6 (in an F-direction) by the conveying roller pair 85. At this time, the switching gate plate 63 is set facing upward toward the second conveying roller pair 87 as the first leading position. As shown in FIG. 10, the paper 100 is therefore upwardly led by the switching gate plate 63 for the front tip portion of the paper 100 to pass on the upper surface of the upper roller 871 of the second conveying roller pair 87 and, when the position of the second folding line 112 of the paper 100 arrives at the folding position (the position immediately under an end portion 621 of the folding plate 62), the conveyance is stopped once. During this, the folding plate 62 maintains staying at the retreat position.

An upper roller 861 of the first conveying roller pair 86 is set to have a width dimension with which the upper roller 861 does not contact the surface of the strip portions 103, and the paste applied to each of the strip portions 103 of the paper 100 does not adhere to the first conveying roller pair 86.

Figure 11:
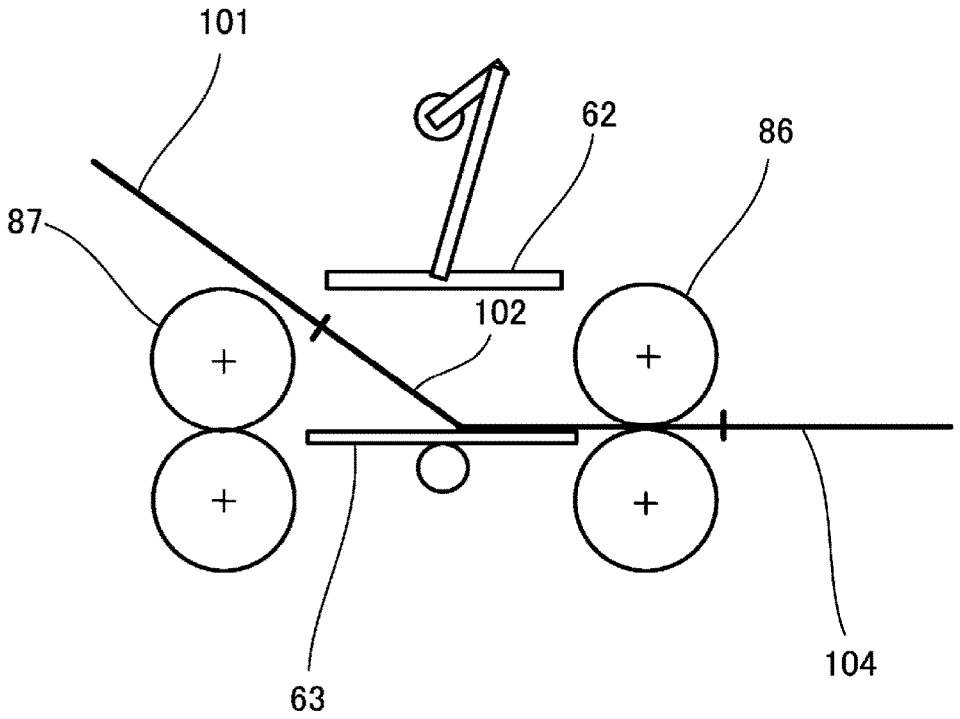
FIG. 11 is a diagram showing the state of the processing for the paper continued from FIG. 10.

As shown in FIG. 11, the folding plate 62 next maintains staying at the retreat position and the switching gate plate 63 is moved to the second leading position (a substantially horizontal position).

Figure 12:
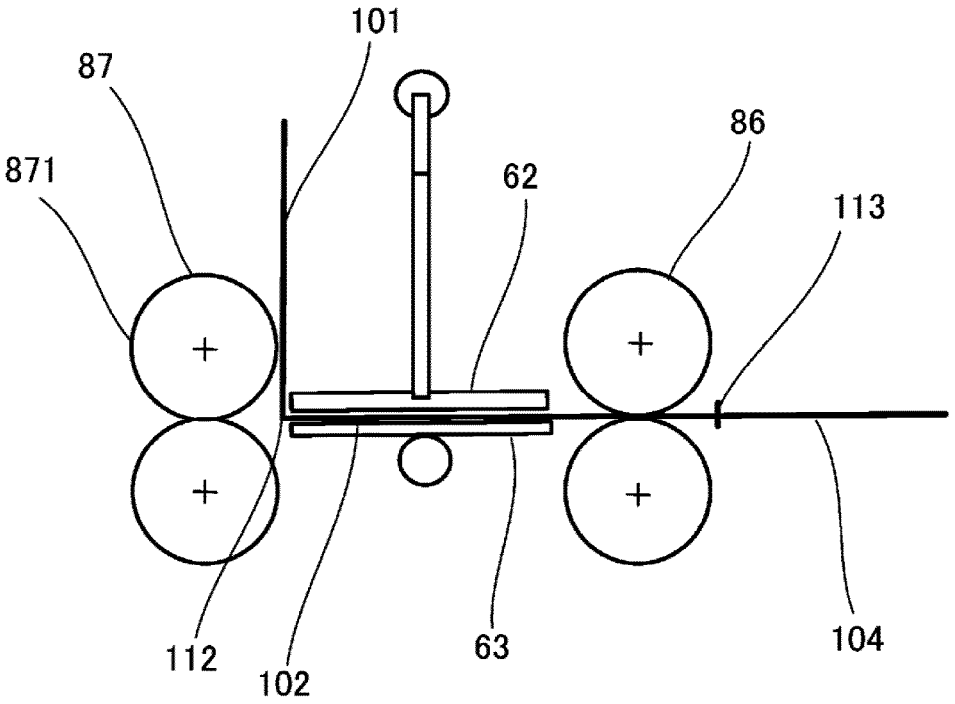
FIG. 12 is a diagram showing the state of the processing for the paper continued from FIG. 11.

As shown in FIG. 12, the folding plate 62 positioned at the retreat position is next lowered to the folding position keeping its substantially horizontal state to clamp the paper 100 on the switching gate plate 63 to thereby fold back the front plane portion 101 of the paper 100 from the second folding line 112 along the surface of the upper roller 871 of the second conveying roller pair 87. At this time, the distance between the switching gate plate 63 and the folding plate 62 after the lowering that are approximated to each other is configured such that a gap is secure through which at least the paper can be conveyed between the folding plate 62 and the switching gate plate 63. For example, the gap of 1 mm is secured.

According to the above, a paper insertion space (a diverging path) and a stopper do not need to be disposed as a paper folding mechanism, and no complexification of the structure is therefore caused and the paper folding device can simply and inexpensively be configured. The position for folding is automatically adjusted matching with each of various types of folding specification by the controller, and a paper folding device excellent in the operability can be provided. Formation of any wrinkle is prevented in the folded back strip portions, and any adverse influence by adhesion of the paste to the inside of the folding mechanism such as the stopper does not also act on the quality of the deliverables in the case where the folding is executed.

Figure 13:
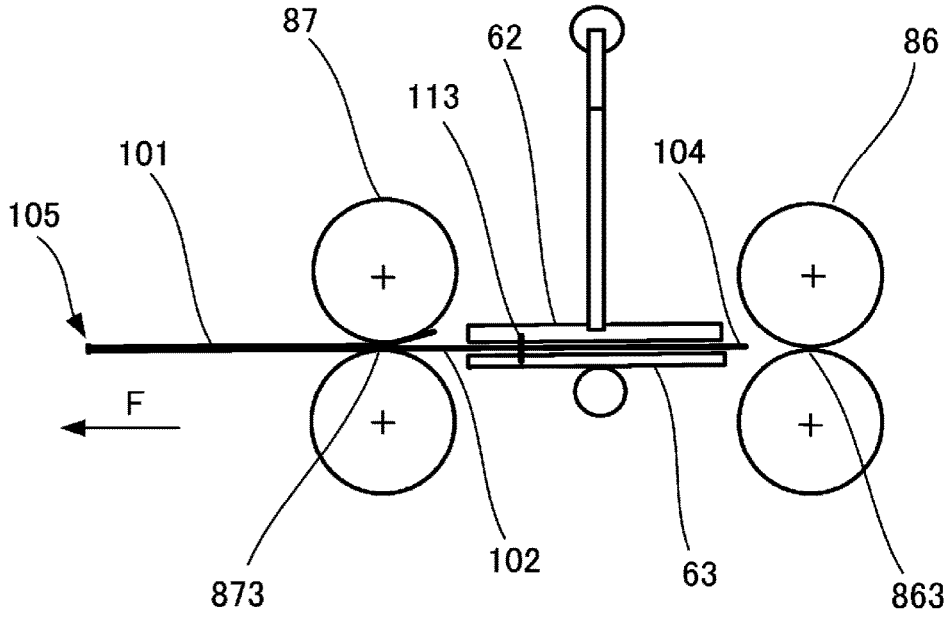
FIG. 13 is a diagram showing the state of the processing for the paper continued from FIG. 12.

As shown in FIG. 13, after the front plane portion 101 of the paper 100 is folded back by the lowering of the folding plate 62, a paper tip flap 105 after the tip portion of the paper is further folded back by the first conveying roller pair 86 is conveyed toward the nip portion 873 of the second conveying roller pair 87 and the tip flap 105 of the paper is clamped by the nip portion 873 of the second conveying roller pair 87 to be conveyed in the F-direction, and the paper tip flap 105 is thereby pressed to be tightly folded. The overall front plane portion 101 is folded back to match with the surface of the back plane portion 102 and, at this time, both of the edge portions of the front plane portion 101 are spliced to the strip portions 103. The Wester-style envelope 90 is thereby acquired. As to the conveyance in the F-direction, the conveyance is executed until the backmost plane portion 104 of the paper 100 passes through the nip portion 863 of the first conveying roller pair 86 by a predetermined amount. At this time, the paper 100 is conveyed through the gap between the folding plate 62 and the switching gate plate 63 (being guided by these plates). According to the above, the paper can reliably be delivered to the pressing part by the nip portion 873 of the second conveying roller pair 87 in the next stage without generating any wrinkle and the like.

According to the above, the control is executed such that, after the tip portion of the paper is folded back by the lowering of the folding plate, the paper tip flap after being folded back is pressed by the nip portion 873 of the second conveying roller pair 87 to be tightly folded, and the tendency to be folded can reliably be imparted to the paper.

The paper folding device (the first folding section 3) of the present invention has been described for the case where the paper folding device is employed as the paper folding mechanism in the paper bag making machine 10 that manufactures the Wester-style envelope as one embodiment while the paper folding device can also be exploited as a paper folding machine that simply folds a paper (a paper folding device). The present invention is not limited to the embodiment and can be exploited with various changes made thereto.

EXPLANATIONS OF LETTERS OR NUMBERS

F conveyance direction
F' conveyance direction
R rotation direction
3 first folding section
6 second folding section
10 paper bag making machine
10A device main body
31 turning shaft
32 folding plate
33 lower guide plate
35 driven roller (pressing roller)
36 upper guide plate
38 driving roller
100 paper
101 front plane portion
102 back plane portion
103 paste margin strip portion
104 backmost plane portion
105 flap
106 flap
111 first folding line
112 second folding line
113 third folding line

The invention claimed is:

1. A paper folding device for folding a flat paper having a body part and a flap projecting from the body part while conveying the paper along a paper conveyance path, the paper folding device comprising:

a folding unit disposed at a folding position where the paper is folded on the paper conveyance path, the folding unit including a folding plate reciprocally turning on a turning shaft substantially parallel to the paper conveyance path, between a placement position where the flap of the paper is placed and an overlap position where the flap is overlapped toward the body part, wherein the folding unit includes a pair of an upper and a lower guide plates that defines part of the paper conveyance path at the folding position, and the folding plate is configured so that, when turning from the placement position to the overlap position, a lower face of the folding plate overlaps an upper face of the upper guide plate of the pair of the upper and the lower guide plates, wherein the folding unit includes:

a pair of conveying rollers to lead the paper such that the body part of the paper passes through between the pair of the upper and the lower guide plates at the folding position on the paper conveyance path; and a controller configured to control driving of the pair of conveying rollers, and wherein when the folding unit folds the flap of the paper, the controller controls to stop the driving of the pair of conveying rollers to stop the conveyance of the paper at the folding position so that the flap of the paper is folded while keeping the body part of the paper between the pair of conveying rollers.

2. The paper folding device according to claim 1, comprising a creasing unit disposed on an upstream side in a paper conveyance direction of the folding position, wherein the creasing unit is configured to form a crease in advance on a folding line used when the flap of the paper is folded.

3. The paper folding device according to claim 1, wherein the folding unit includes a pair of folding units having a first folding unit and a second folding unit that are disposed facing each other on both sides in a width direction perpendicular to the paper conveyance direction, and the first folding unit and the second folding unit each includes the folding plate that turns around the turning shaft along the conveyance direction.

4. The paper folding device according to claim 3, comprising a conveying unit disposed between the first folding unit and the second folding unit, the conveying unit conveying the paper while holding a central portion of the paper on the conveyance path.

5. The paper folding device according to claim 4, wherein the conveying unit includes pairs of upper and lower conveying rollers, and the upper conveying rollers of the pairs of the upper and lower conveying rollers are unitized to be attachable to and detachable from a paper folding device main body.

6. A paper folding method executed in a paper folding device for folding a flat paper having a body part and a flap projecting from the body part while conveying the paper along a paper conveyance path, the method comprising:

folding the flap of the paper by reciprocally turning a folding plate on a turning shaft substantially parallel to the paper conveyance path, between a placement position where the flap of the paper is placed and an overlap position where the flap of the paper is overlapped toward the body part, the folding plate being disposed at a folding position where the flap of the paper is folded in the paper conveyance path, wherein a pair of an upper and a lower guide plates defines part of the paper conveyance path at the folding position, and when the folding plate turns from the placement position to the overlap position, the folding plate turns such that a lower face of the folding plate overlaps an upper face of the upper guide plate of the pair of the upper and the lower guide plates, and wherein:

a pair of conveying rollers to lead the paper such that the body part of the paper passes between the pair of the upper and the lower guide plates are disposed at the folding position on the paper conveyance path, and in the folding the flap of the paper, driving of the pair of conveying rollers is stopped thereby stopping conveyance of the paper at the folding position and the flap of the paper is folded while keeping the body part of the paper between the pair of conveying rollers.

7. The paper folding method according to claim 6, wherein after folding the flap of the paper, the folding plate turns by a predetermined angle from the overlap position toward the placement position, and the driving of the pair of conveying rollers is thereafter brought to a driving state to start the conveyance of the paper to convey the paper after undergoing the folding toward a downstream side in a paper conveyance direction of the folding position.

* * * * *